US005700206A

United States Patent [19]

Lin

[11] Patent Number: 5,700,206

[45] Date of Patent: Dec. 23, 1997

[54] GOLF PUTTER STRUCTURE

[76] Inventor: Shen-Ju Lin, 2F, No. 11-1, Hsin-Shin Street, Pei-Tou, Taipei, Taiwan

[21] Appl. No.: 761,523

[22] Filed: Dec. 6, 1996

[51] Int. Cl.[6] ..... A63B 53/04

[52] U.S. Cl. ..... 473/293; 473/313; 473/328; 473/325; 473/340

[58] Field of Search ..... 473/313, 340, 473/341, 251, 282, 293, 410, 412, 325, 243, 328, 349, 324; D21/217

[56] References Cited

U.S. PATENT DOCUMENTS

| | | | |
|---|---|---|---|
| 653,483 | 7/1900 | McCrea | 473/325 |
| 1,096,359 | 5/1914 | Dwight | 473/337 |
| 2,789,823 | 4/1957 | Bennett | 473/325 |
| 2,843,384 | 7/1958 | Schmidt | 473/293 |
| 3,416,798 | 12/1968 | Pennington | 473/325 |
| 3,486,755 | 12/1969 | Hodge | 473/293 |
| 3,981,507 | 9/1976 | Nunziato | 473/340 |
| 4,295,650 | 10/1981 | Keeble | 473/325 |
| 4,523,758 | 6/1985 | Guendling | 473/293 |
| 4,964,639 | 10/1990 | Tucker | 473/293 |
| 5,072,941 | 12/1991 | Klein | 473/328 |
| 5,125,657 | 6/1992 | Beil | 473/293 |
| 5,584,769 | 12/1996 | Sundin | 473/325 |

*Primary Examiner*—Sebastiano Passaniti

[57] ABSTRACT

A golf putter includes a handle having a lower end to which a head is fixed. The head has a left side face and a right side face. The left and right side faces are symmetrical to each other and may both be used to putt a golf ball. The head further has a front face which may also be used to putt the golf ball as the player stands facing the target hole and spaces his or her legs on both sides of the ball. The putter is then swung under the crotch and between the legs of the player as a pendulum to putt the ball with the front face thereof which is substantially normal to the horizontal as it gets into contact with the ball. The handle of the putter is shortened as compared to the conventional putter to facilitate the swinging operation.

3 Claims, 7 Drawing Sheets

GOLF PUTTER STRUCTURE

FIELD OF THE INVENTION

The present invention relates to a golf putter structure and in particular to a novel putter design which allows a player to select desired hitting posture and enhances the controllability of both the direction and magnitude of the force applied to hit a golf ball.

BACKGROUND OF THE INVENTION

Golf has been a popular sport. A set of golf clubs include wood clubs, iron clubs and a putter. The clubs may also be classified as left hand (sinistral) clubs and right hand (dexterous) clubs. Usually, the putter is used to "putt" the golf ball into a hole in the green. For a dexterous player, the traditional way to putt the ball is that the player stands next to the ball to have the toe tips forming a first line which is parallel with, but not coincident with a second line connecting between the target hole and the ball. The player has to simultaneously watch the hole and the ball and then putt the ball toward left hand side of his or her body. This makes it very difficult to control the direction and magnitude of the force applied to putt the ball, especially for a golf learner or someone who is not very skilled in playing golf.

Further, there are often obstacles in the golf course, such as bushes, fences and water hazards or ponds. Once the ball falls next to these obstacles, it is sometimes located at a side that is adverse to putter for the particular player. For example, for a dexterous player who is used to standing at the left side of the ball if facing the target hole, if the ball is located at for example right side of a pond, then it is very inconvenient for the player to putter or hit the ball in his or her regular way.

Providing a novel putter structure to allow a player to overcomes such problems would be of great help to the player and thus a novel design of the putter is disclosed herein which will be further discussed hereinafter.

SUMMARY OF THE INVENTION

The principal object of the present invention is to provide a golf putter structure which helps a player to overcome the above-discussed problem encountered in the traditional putter.

It is another object of the present invention to provide a golf putter structure which allows a player to putter a ball from either sides, namely standing either at the right side or left side of the ball.

In accordance with the present invention, there is provided a golf putter structure comprising a handle having a lower end to which a head is fixed. The head has a left side face and a right side face. The left and right side faces are symmetrical to each other and may both be used to putt a golf ball. The head further has a front face which may also be used to putt the golf ball as the player stands facing the target hole and spaces his or her legs on both sides of the ball. The putter is then swung under the crotch and between the legs of the player as a pendulum to putt the ball with the front face thereof which is substantially normal to the horizontal as it gets into contact with the ball. The handle of the putter is shortened as compared to the conventional putter to facilitate the swinging operation.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
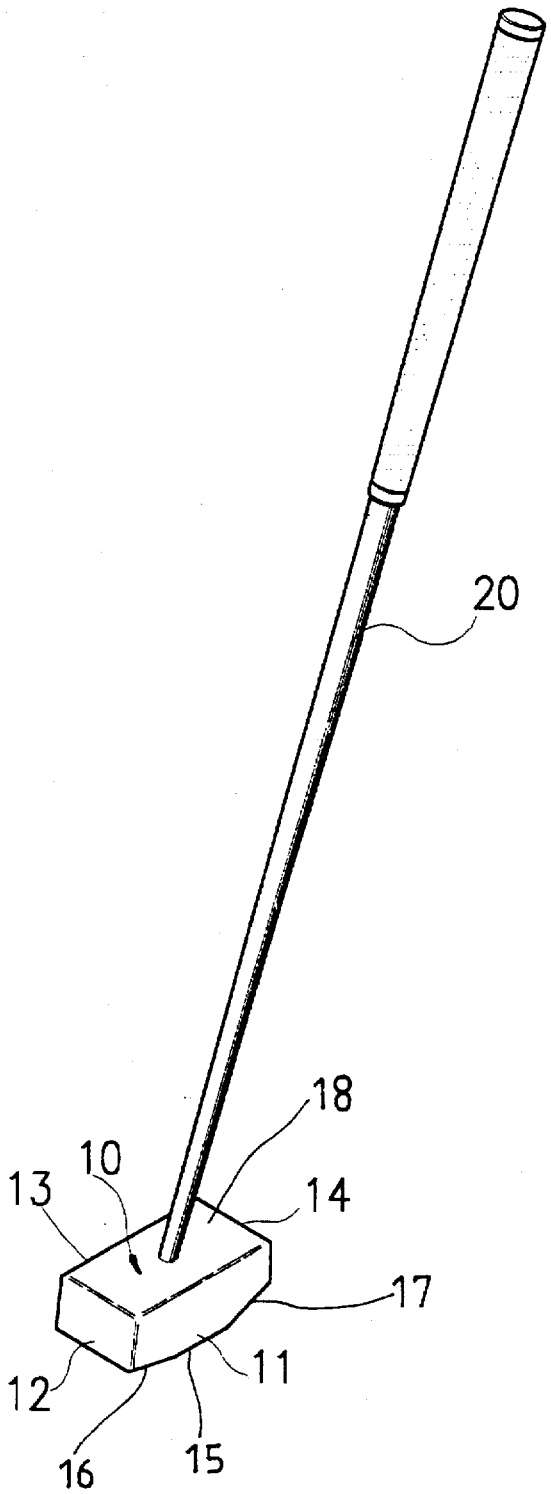
FIG. 1 is a perspective view showing a golf putter structure in accordance with the present invention.
Figure 2:
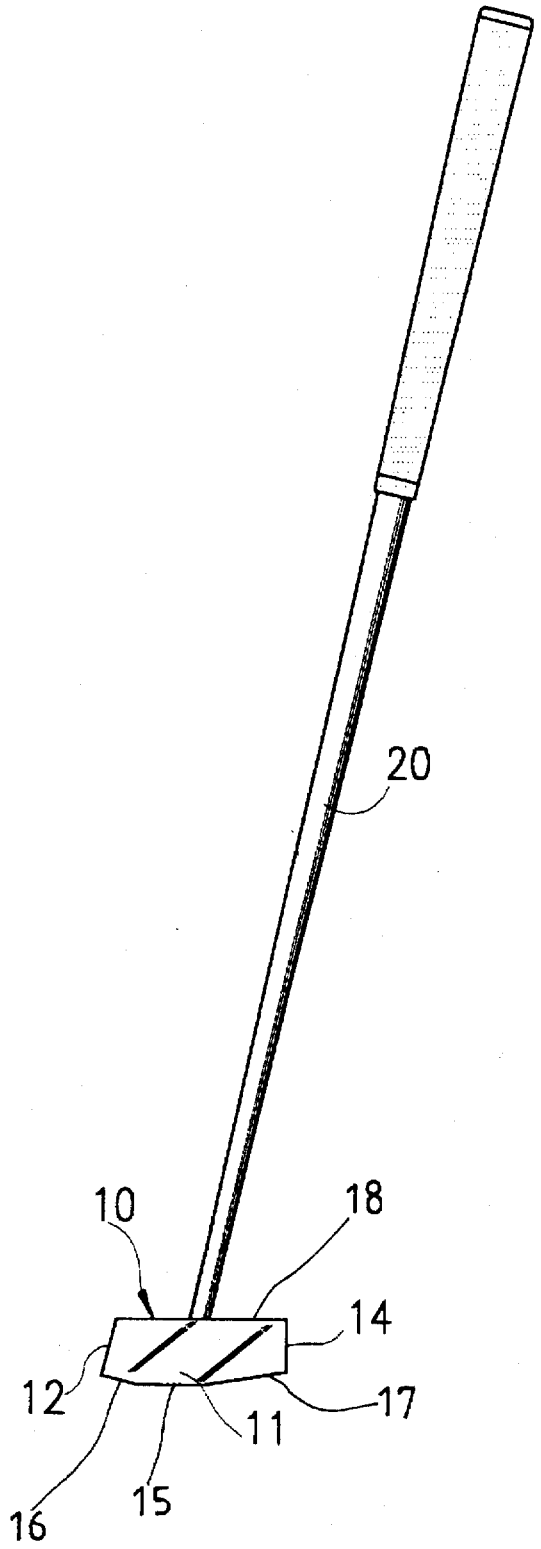
FIG. 2 is a side elevational view of the golf putter structure in accordance with the present invention.

With reference to the drawings and in particular to FIGS. 1 and 2 which respectively show a perspective view and a side elevational view of a golf putter structure in accordance with the present invention, the golf putter comprises an elongated handle 20 having a lower end to which a head 10 is mounted. The head 10 has a top face 18 to which the handle 20 is fixed and an opposite bottom face 15. Preferably, the handle 20 is fixed to a center of the top face 18 and define therebetween an angle rather than a right angle.

The head 10 also has a left side face 11 and a right side face 13 which define two opposite and symmetrical plains spaced from each other and extending from the top face 18 to the bottom face 15. Both the left side face 11 and the right side face 13 may serve as hitting face to putt a golf ball in a conventional way toward the right hand side or left hand side of the player's body.

In a regular position of the putter of the present invention to putt a ball, the handle 20 is inclined relative to the vertical, as shown in FIG. 2, while the top face 18 of the head 10 is substantially parallel with the horizontal.

The head 10 comprises a front face 12 which is substantially parallel with the handle 20 so that when the putter is in the putting position, as shown in FIG. 2, the front face 12 is inclined relative to the vertical. The head 10 has a rear face 14, opposite to the front face 12 and inclined toward the handle 20 as extending upward so that when the putter is in the putting position shown in FIG. 2, the rear face 14 is substantially parallel with the vertical line. Both the front face 12 and the rear face 14 extend from the top face 18 to the bottom face 15 and connect between the left and right side faces 11 and 13.

The bottom face 15 is substantially horizontal when the putter is in the putting position shown in FIG. 2. Preferably, the bottom face 15 comprises a front inclination section 16 and a rear inclination section 17 which are inclined relative to the horizontal and toward the front and rear faces 12 and 14 when the bottom face 15 is in the putting position. Preferably the front inclination section 16 is smaller than the rear inclination section 17, namely, the degree of inclination of the front inclination section 16 is smaller than the rear inclination section 17 as shown in FIG. 2, so that the front portion of the head 10 may have a greater weight and a larger volume than the rear portion.

Figure 3:
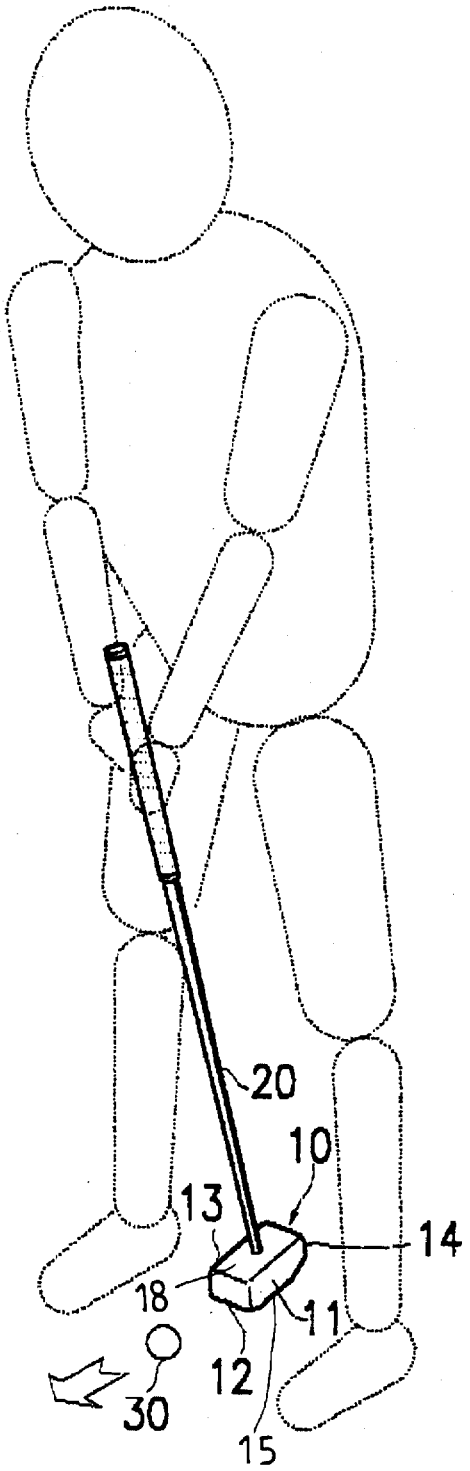
FIG. 3 is a perspective view showing a player using the front face of the putter of the present invention to putt.

The configuration of the putter as shown in FIG. 2 allows a player to putter a golf ball (designated with reference numeral 30 in FIG. 3) with the front face 12 as shown in FIG. 3 for the front face 12 is substantially normal to the horizontal when it comes into contact and thus hits the ball 30. Putting the ball 30 with the front face 12 of the putter of the present invention is achieved by for example swinging the putter 20 as a pendulum to have the front face 12 hitting the ball 30 when the front face 12 is substantially normal to the horizontal. The kinematic energy of the head 10 drive the ball 30 to move frontward when the player is fronting a target hole (not shown) to which the ball is desired to move. The greater weight of the front portion of the head 10 helps to drive the ball 30 with the inertial force thereof.

Figure 9:
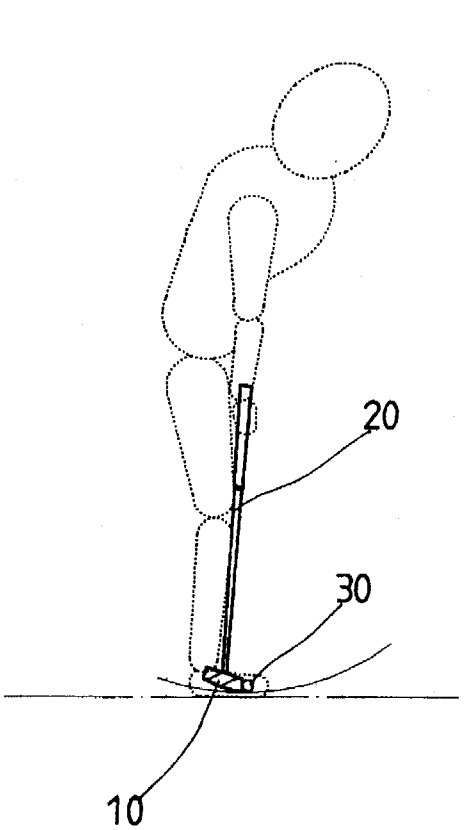
FIG. 9 is a side eleavtional view showing the player using the front face of the putter of the present invention to putt.
Figure 8:
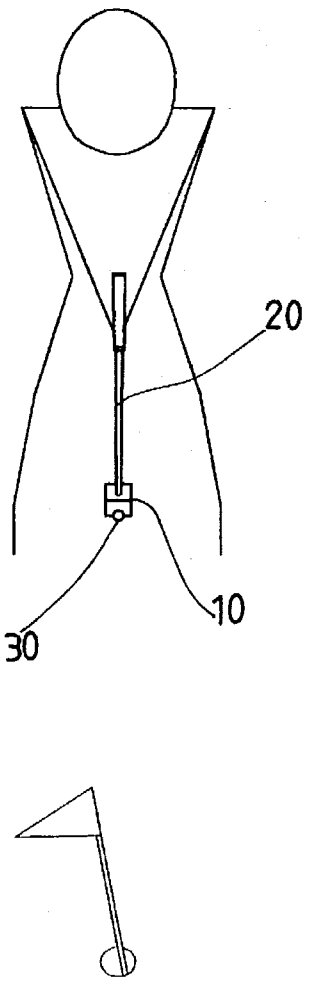
FIG. 8 schematically shows the body configuration of the player when the player is using the front face of the putter to putt.
Figure 7:
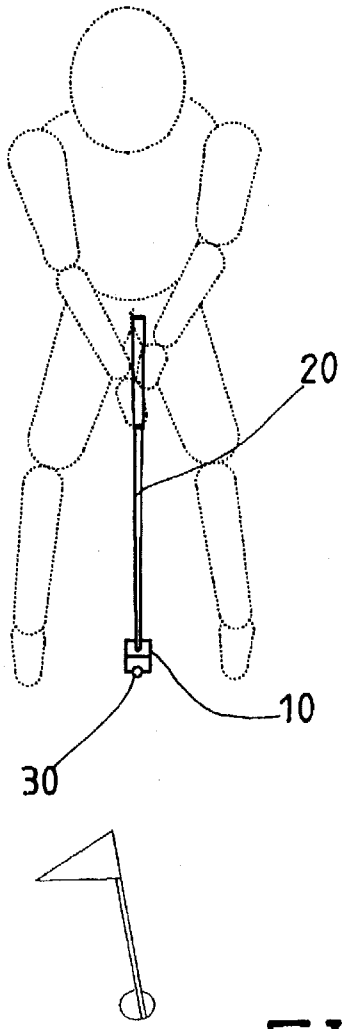
FIG. 7 is a front view showing a player using the front face of the putter of the present invention to putter.

FIGS. 7–9 illustrate the posture and the action that the player may take to use the front face 12 of the putter to putt the golf ball 30.

Still referring to FIG. 3, the pendulum swinging operation of the putter of the present invention may be achieved by having the legs of the player (schematically shown by phantom lines) spaced from each other and standing on both sides of the ball 30 with the ball 30 substantially located at midway along a line connecting between the toe tips of feet of the player. The player is now facing the target hole and the line connecting the ball 30 to the target hole is substantially normal to the line connecting the toe tips of the player. The player holds the handle 20 to have the head 10 swinging through between the legs so as to hit the ball 30 toward the target hole. The posture of the player in this manner is very stable in hitting the ball so that a firm and correct putting may be readily achieved.

To allow the putter of the present invention to swing under the crotch and between the legs of the player, the handle 20 of the putter in accordance with the present invention is shortened, as compared with the conventional putter.

Figure 4:
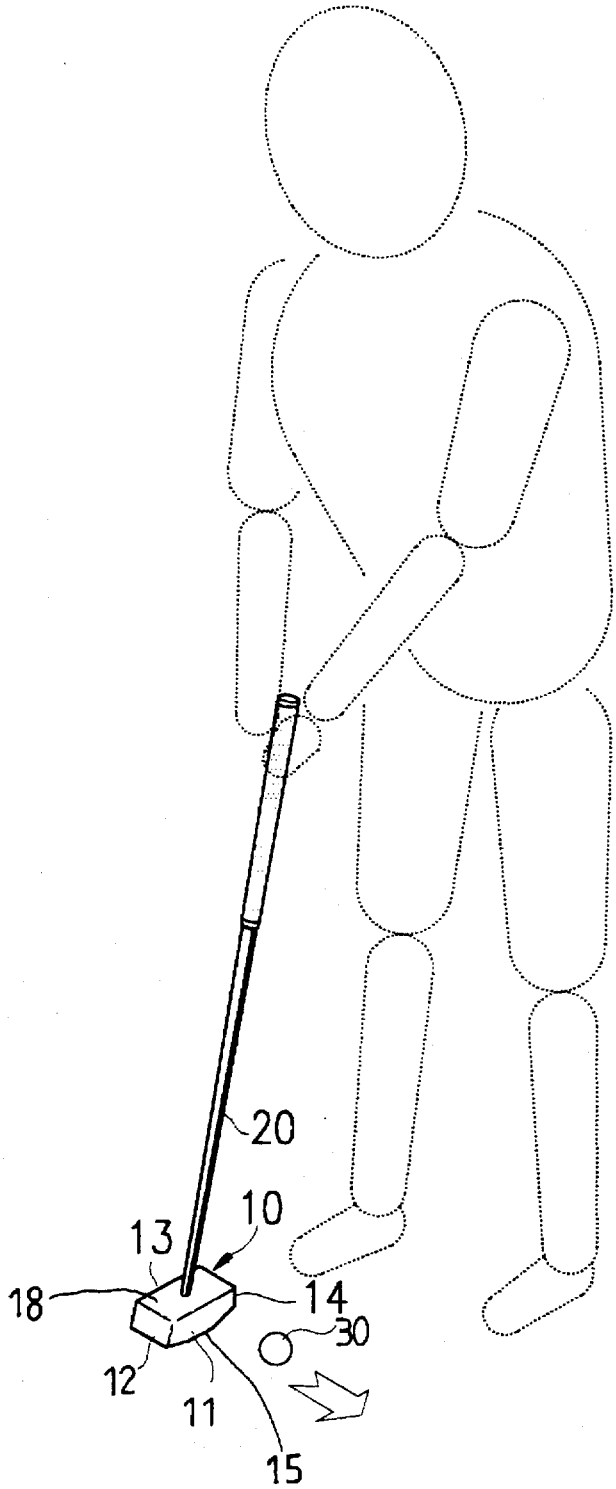
FIG. 4 is a perspective view showing a player using the left side face of the putter of the present invention to putt.
Figure 5:
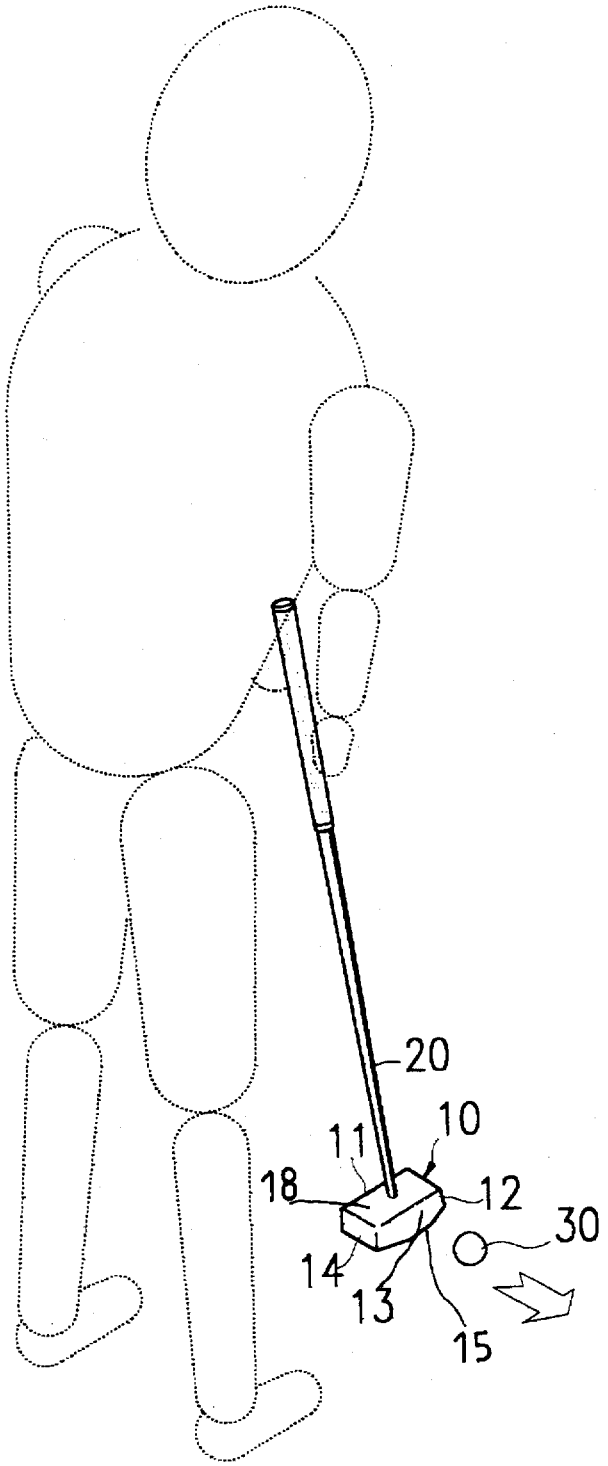
FIG. 5 is a perspective view showing a player using the right side face of the putter of the present invention to putt.

FIGS. 4 and 5 respectively show putting a ball 30 with the left side face 11 and the right side face 13 of the head 10. In accordance with the present invention, the left and right side faces 11 and 13 are made identical and symmetrical with respect to each other so that both the left and right side faces 11 and 13 may be used to putt a ball as a conventional putter. To putt with the left and right side faces 11 and 13 is similar to the conventional putter and thus no further detail is needed herein.

Figure 6:
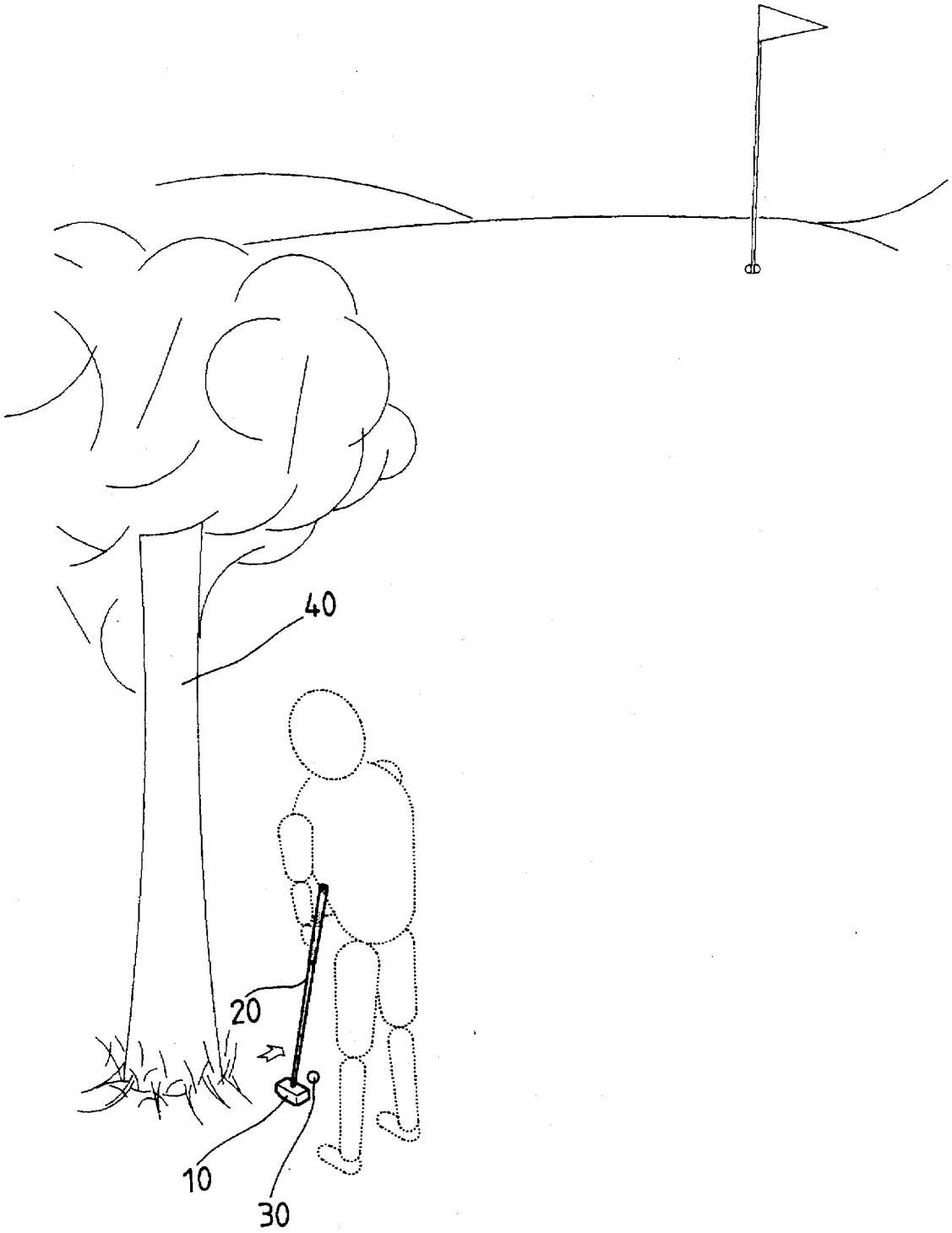
FIG. 6 is a perspective view showing a player using the right side face of the putter of the present invention to putt a ball located close to an obstacle.

In FIG. 6, it illustrates to putt a ball 30 located close to an obstacle, such as a tree 40 in this example. In the condition shown in FIG. 6, it is very difficult for a dexterous player to putt the ball 30 with the conventional putter, for it is not possible for the player to stand on the left side, as viewing toward the target hole. However, by using the putter constructed in accordance with the present invention, it is possible for the dexterous player to adopt a sinistral player's way (posture) to putt the ball 30 with the same putter constructed in accordance with the present invention, for the present inventive putter is provided with both a left side hitting face 11 and a right side hitting face 13. This also applicable to a sinistral player encountering a similar situation.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. A golf putter structure comprising a handle having a lower end to which a head is mounted, the head comprising a top face attached to the lower end of the handle, a bottom face opposite to the top face, a front face which is substantially parallel with the handle, serving as a primary golf ball hitting face, a rear face which is inclined toward the handle as extending from the bottom face to the top face, a left side face and a right side face which is opposite to and symmetrical to the left side face, both the left and right side faces also serving as ball hitting faces, the bottom face comprising a front section that is inclined toward the front face and a rear section that is inclined toward the rear section, the front section and the rear section of the bottom face being configured so that the front face of the head has a bottom to top dimension greater than that of the rear face, the handle being attached to approximately a center of the top face and defining an angle rather than a right angle with respect to the top face, the handle having a length so as to allow the putter to be adapted to swing under the crotch and between the legs by a golf player, wherein the putter is movable as a pendulum by the player to have the front face thereof to contact and drive a golf ball toward a front direction relative to the player so as to allow the player to control direction and magnitude of force applied by the player to putt the ball.

2. The golf putter as claimed in claim 1, wherein the left side face and the right side face are symmetrical to each other so that the putter is suitable to both a sinistral player and a dexterous player.

3. The golf putter as claimed in claim 1, wherein the left side face and the right side face are symmetrical to each other so that the player in encountering a condition that an obstacle located closely next to the ball may select the suitable one of the left and right side faces to hit the ball.

* * * * *